US011391057B2

(12) United States Patent
Hoggan

(10) Patent No.: US 11,391,057 B2
(45) Date of Patent: Jul. 19, 2022

(54) WINGED SLAT

(71) Applicant: Patrick R. Hoggan, North Logan, UT (US)

(72) Inventor: Patrick R. Hoggan, North Logan, UT (US)

(73) Assignee: Privacylink, LLC, Smithfield, UT (US)

( * ) Notice: Subject to any disclaimer, the term of this patent is extended or adjusted under 35 U.S.C. 154(b) by 0 days.

(21) Appl. No.: 17/401,659

(22) Filed: Aug. 13, 2021

(65) Prior Publication Data

US 2021/0396039 A1 Dec. 23, 2021

Related U.S. Application Data

(63) Continuation of application No. 14/973,323, filed on Dec. 17, 2015, now Pat. No. 11,091,932.

(51) Int. Cl.
*E04H 17/06* (2006.01)

(52) U.S. Cl.
CPC ..... *E04H 17/066* (2013.01)

(58) Field of Classification Search
CPC ..... E04H 17/02; E04H 17/04; E04H 17/05; E04H 17/06; E04H 17/066; E04H 17/164
See application file for complete search history.

(56) References Cited

U.S. PATENT DOCUMENTS 3,227,423 A * 1/1966 De Matteo ..... E01F 7/02 256/12.5
5,775,676 A * 7/1998 Hoggan ..... E04H 17/066 256/32
5,806,839 A * 9/1998 Meglino ..... E04H 17/066 256/1
6,164,628 A * 12/2000 Hoggan ..... E04H 17/066 256/32
6,966,547 B2 * 11/2005 Colliander ..... E04H 17/066 256/1
11,091,932 B2 * 8/2021 Hoggan ..... E04H 17/066
2008/0135820 A1 * 6/2008 Hoggan ..... E04H 17/066 256/1
2011/0240940 A1 * 10/2011 Kohls ..... E04H 17/066 256/34

* cited by examiner

*Primary Examiner* — Michael P Ferguson
(74) *Attorney, Agent, or Firm* — Preston P. Frischknecht; Project CIP

(57) ABSTRACT

A winged slat for retaining the slat inside a chain link fence. The winged slat may have a body with first and second sides and one or more pairs of fins, joined to each other at a vertex, and longitudinally disposed at a side of the slat body. Some versions of the slat include a dual-winged slat with a first pair of such fins on one side, and a second pair of fins on an opposite side. Some slat versions omit a precise vertex and have fin pairs that attach to the slat body at substantially the same location. Fin pairs may be arranged asymmetrically around the slat body. Each pair of fins may have a combination of straight and/or angled fins.

9 Claims, 6 Drawing Sheets

WINGED SLAT

RELATED PATENTS

This patent application is a continuation of U.S. patent application Ser. No. 14/973,323, filed on Dec. 17, 2015, and claims priority thereto.

BACKGROUND OF THE INVENTION

Field of the Invention

This invention relates to slats which are inserted into chain link fences in order to increase privacy and security.

Description of the Related Art

The slat of U.S. Pat. No. 6,634,623 possesses a body member 19 having a front surface 28, a parallel rear surface 30, and two shorter connecting parallel sides 27 and 29. Fins 21 and 22 may originate (a) near the centers of sides 27 and 29 or (b) from opposite corners of a side 27 or 29 and the front surface 28 or the rear surface 30. But the fins 21 and 22 do not originate from any intermediate point between the center of a side 27 or 29 and a surface (front 28 or rear 30). Each of the fins 21 and 22 extends at an acute angle relative to its respective side of origination 27 or 29 to reach the plane of the surface 28 or 30 toward which such fin 21 or 22 is angled. The slat of U.S. Pat. No. 6,634,623 has, however, no straight fin. Likewise, in another multi-finned slat disclosed in U.S. Pat. No. 5,806,839, there is no indication of any angled fin.

Lines 16 through 26 in column 2 of U.S. Pat. No. 6,164,628 indicate, "For purposes of providing privacy and providing a self-locking slat that is automatically securable in a channel of a chain link fence . . . first and second fins [20*a* and 20*b*] may extend from and along longitudinal sides of the body member, proximate a proximal [toward the front side of the chain link fence 16, according to lines 12 through 13 of column 4] face sheet . . . of the body member, laterally and proximately, toward and into the knuckles of the chain link fence to frictionally engage the knuckles, and specifically, the twisted wires at intersections of the wire mesh fencing fabric." Line 65 of column 4 through line 4 of column 5 further explain, " . . . the fins 20*a*, 20*b* are configured to extend proximately, relative to the body member 24. In particular, and relative to a proximal face sheet 26 of the body member 24, the fins 20*a*, 20*b* are oriented at an angle, [α], the angle being between about 0° and about 30° and, more preferably, between about 0° and 20°, and in a preferred embodiment, between about 5° and 15°."

Further, according to lines 41 through 51 of column 2, "[i]n another embodiment of the present invention, the . . . slats further include third and fourth fins for inhibiting rotational movement of the slat relative to the channel [of a chain link fence]. More specifically, in this embodiment, third and fourth fins extending along and from longitudinal sides of the body member, proximate a distal [toward a back side or face of the chain link fence, according to lines 10 through 11 of column 4] face sheet . . . of the body member, are provided to abuttingly engage distal portions of the wire mesh fencing fabric to inhibit rotational movement of the slats within corresponding channels.

Lines 13 through 21 in column 5 continue, "[i]n particular, and as illustrated in FIGS. 1, 3-5, fins 30*a*, 30*b* extend at least laterally outwardly toward knuckles 18, and extend distally, relative to the body member 24, to engage distal portions 14*b* of the wire and mesh fencing fabric 14. In one embodiment, the fins 30*a*, 30*b* are oriented at an angle, β, relative to a distal face sheet 28 of the body member 24, the angle β being between about 35° and 55° and, more preferably, between about 40° and 50° .

Therefore, the slat of U.S. Pat. No. 6,164,628 can have an angled fin and a straight fin on each side of the body member, but the fins are not asymmetrically arranged, i.e., as defined herein the straight fins are not diagonally opposite to one another, and the angled fins are not diagonally opposite to one another; if straight fins exist, the angled fins do not have their respective free ends angled toward opposite faces of the slat; an angled fin and a straight fin are not attached at the same place to the body member; and no fin is attached to the body member other than at a corner, i.e., as defined herein, where a side meets a face.

The fins of the slat in U.S. Pat. Nos. 5,584,468 and 5,899,442 can, according to lines 60 through 61 in column 4 of U.S. Pat. No. 5,584,468 and the identically worded statement in lines 62 through 64 from column 4 in U.S. Pat. No. 5,899,442, on each side be angled toward or away from each other; but there is no indication in either patent (1) that the angled fins are diagonally opposite to one another simultaneously with straight fins being diagonally opposite to one another, i.e., there is no indication that fins comprising a set of two angled fins and a set of two straight fins are asymmetrical or (2) that any two fins originate from the same place on a given side of the slat.

The inventor is, moreover, unaware of any fence slat having an angled fin and a straight fin originating from a given side of a slat wherein the angled slat originally proceeds perpendicularly to the side of the slat before extending at an angle from such perpendicular portion.

BRIEF SUMMARY OF THE INVENTION

The winged slat for a chain link fence of the present invention includes a body with a first and second sides, a pair of fins joined to each other at a vertex and longitudinally disposed on one of the first and second sides of the body. Alternatively, fin pairs may omit a joining vertex, but attach to the generally rectangular body at substantially the same location. Embodiments may also include a dual-winged slat with a generally rectangular body, with a front, back, first side, and second side, a first pair of fins joined to each other at a first vertex and longitudinally disposed on the first side of the generally rectangular body, and a second pair of fins joined to each other at a second vertex and longitudinally disposed on the second side of the generally rectangular body. Pairs of fins may be arranged asymmetrically around the body. The body may be either solid or hollow. If the body is hollow, the body preferably contains at least one, and most preferably two, internal walls which are parallel to the edges of the body and connected at the tops and bottoms of the walls to the front face and to the rear face of the body of the slat.

DETAILED DESCRIPTION OF THE INVENTION

Figure 1:
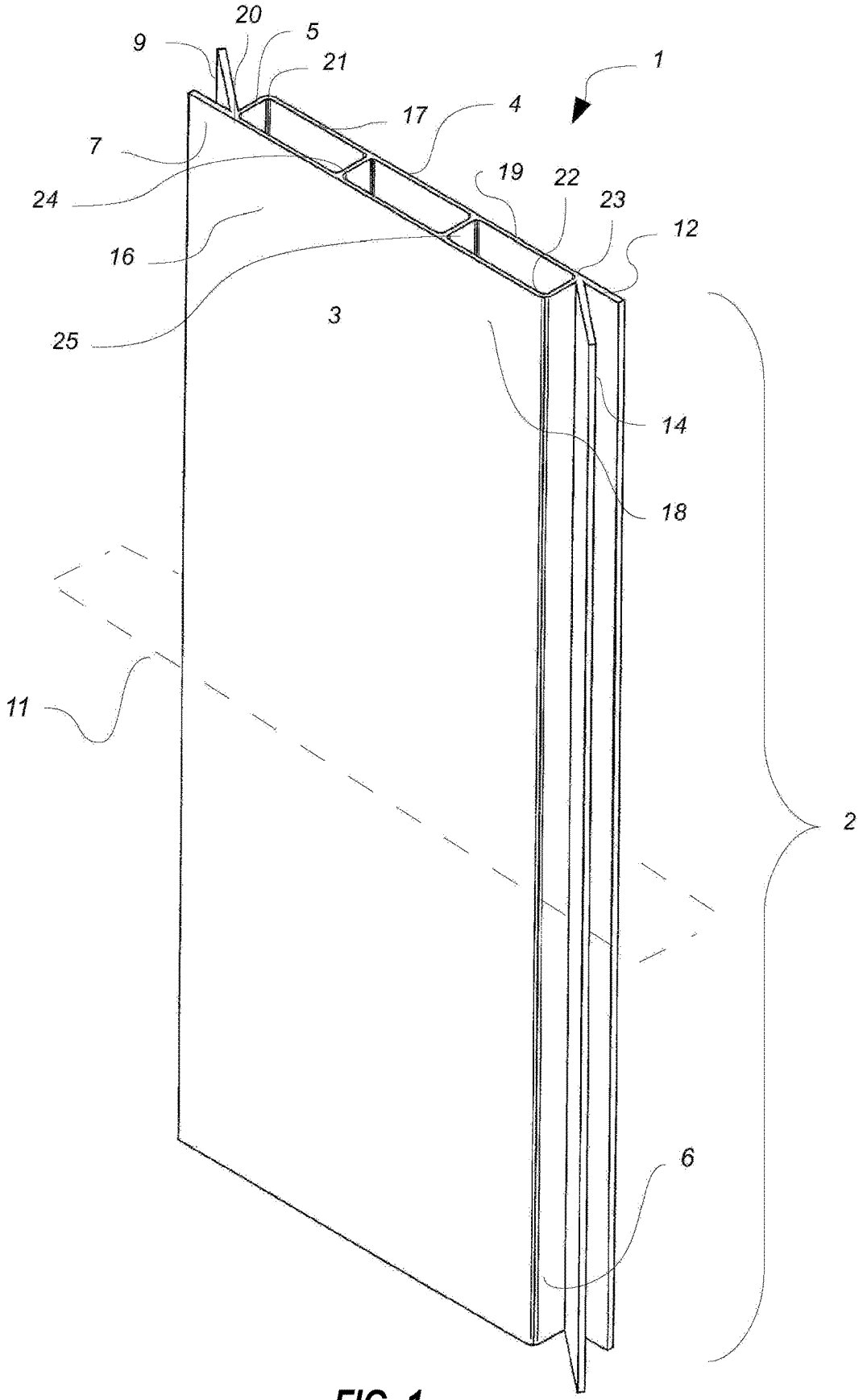
FIG. 1 is a perspective view of a preferred embodiment for a winged slat.

As stated above and as illustrated in FIGS. 1 through 11, the winged Slat 1 of the present invention has a rectangular body 2 comprising a front face 3, a rear face 4, a first edge (or side) 5, and a second edge (or side) 6. There is, further, a first straight fin 7 having a first end 8 and a first angled fin 9 having a first end 10 with each of the first ends 8, 10 attached to the first edge 5 with the first end 10 of the first angled fin 9 being no closer to the front face 3 than is the first end 8 of the first straight fin 7, with the first angled fin 9 being angled (in the transverse plane 11, which is shown in FIG. 1, with respect to the body 2 of the slat 1) at an angle $\alpha'$ toward the rear face 4 of the body 2. Similarly, a second straight fin 12 having a first end 13 and a second angled fin 14 having a first end 15 are attached by their respective first ends 13, 15 to the second edge 6 with the first end 15 of the second angled fin 14 being no closer to the rear face 4 than is the first end 13 of the second straight fin 12, with the second angled fin 14 being angled (in the transverse plane 11 with respect to the body 2 of the slat 1) at an angle $\alpha''$ toward the front face 3 of the body 2 Optionally the fins 7, 9, 12, 14 can be integrally formed with the body 2.

In accordance with tradition for fins 7, 9, 12, 14 and slats 1 and as illustrated in FIG. 1, the connection of the fins 7, 9, 12, 14 to the body 2 of the slat 1 extends longitudinally along the edges 5, 6 of the body 2 of the slat 1.

The body 2 may be either solid or hollow and is preferably hollow, as illustrated in FIGS. 1 through 11. When the body 2 is hollow, such body 2 is preferably comprised of the first edge 5 connecting a first side 16 of the front face 3 to a first side 17 of the rear face 4 and with the second edge 6 connecting a second side 18 of the front face 3 to a second side 19 of the rear face 4, preferably by having a front end 20 of the first edge 5 connected to the first side 16 of the front face 3, a rear end 21 of the first edge 5 attached to the first side 17 of the rear face 4, a front end 22 of the second edge 6 attached to the second side 18 of the front face 3, and a rear end 23 of the second edge 6 connected to the second side 19 of the rear face 4. And most preferably, the hollow body 2 contains at least one and, preferably, two internal walls 24, 25 which are preferably parallel to the edges 5, 6 of the body 2 of the slat 1. The front end 26 of the first wall 24 is attached to the front face 3 of the body 2, and the rear end 27 of the first wall 24 is connected to the rear face 4. Similarly, the front end 28 of the second wall 25 is attached to the front face 3 of the body 2, and the rear end 29 of the second wall 25 is connected to the rear face 3. All component of the hollow body 2 are preferably integrally formed.

In certain embodiments, the free end 30 of the first straight fin 7 must be closer to the plane 31 containing the front face 3 of the body 2 of the slat 1 than is the free end 32 of the first angled fin 9. And, in certain embodiments, the free end 33 of the second straight fin 12 must be closer to the plane 34 containing the rear face 4 of the body 2 of the slat 1 than is the free end 35 of the second angled fin 14.

Furthermore, neither the first straight fin 7 nor the first angled fin 9 can be attached to the first edge 5 more than halfway from the front face 3 to the rear face 4, and neither the second straight fin 12 nor the second angled fin 14 can be attached to the second edge 6 more than halfway from the rear face 4 to the front face 3.

Figure 2:
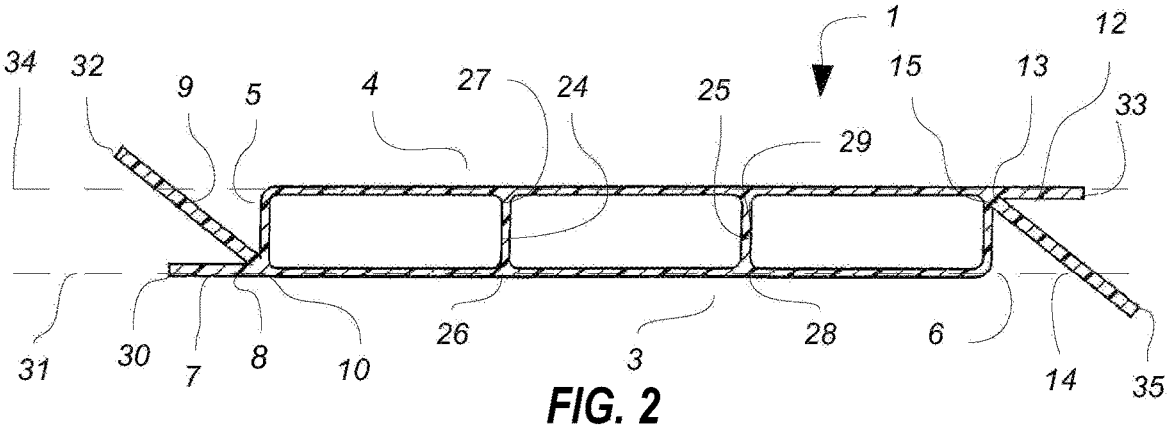
FIG. 2 is a cross-sectional transverse view of a second embodiment of a winged slat.
Figure 3:
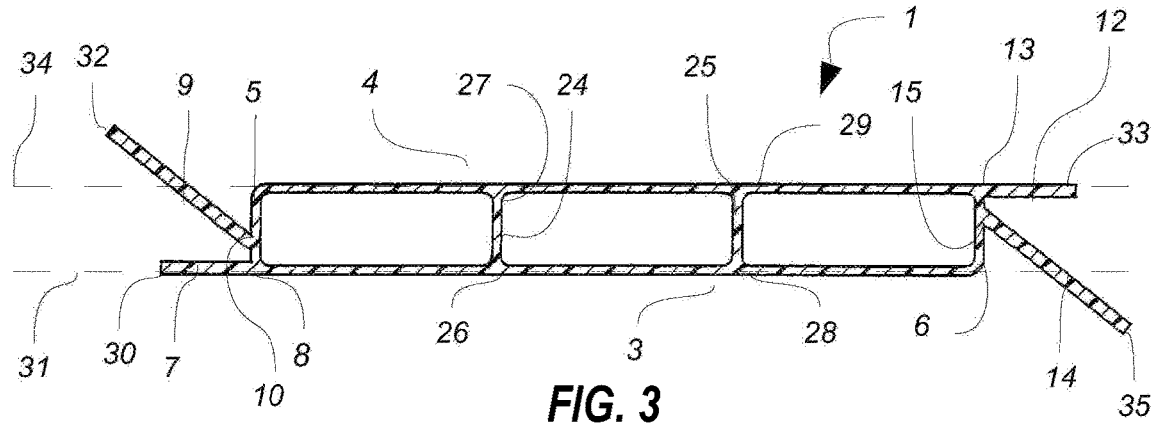
FIG. 3 is a cross-sectional transverse view of a third embodiment of a winged slat.
Figure 4:
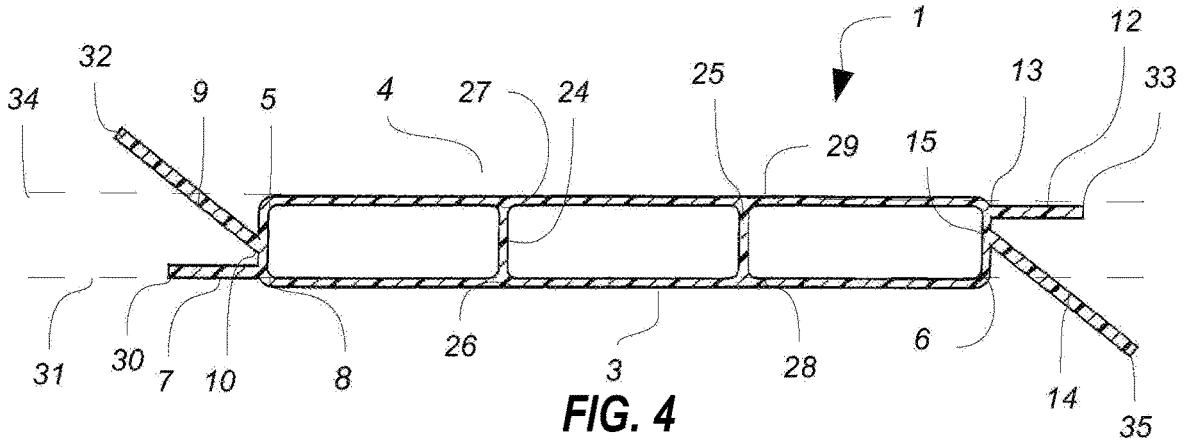
FIG. 4 is a cross-sectional transverse view of a fourth embodiment of a winged slat.
Figure 5:
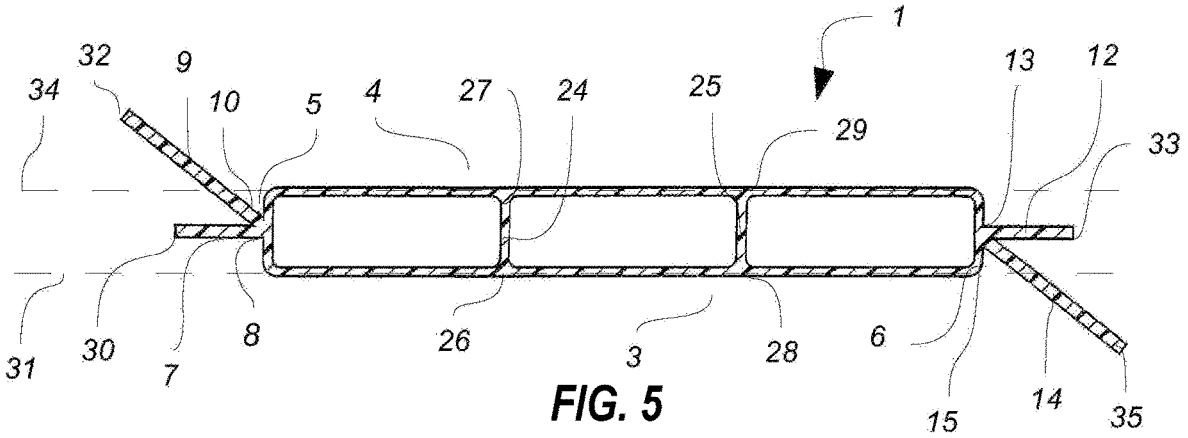
FIG. 5 is cross-sectional transverse view of a fifth embodiment of a winged slat.
Figure 6:
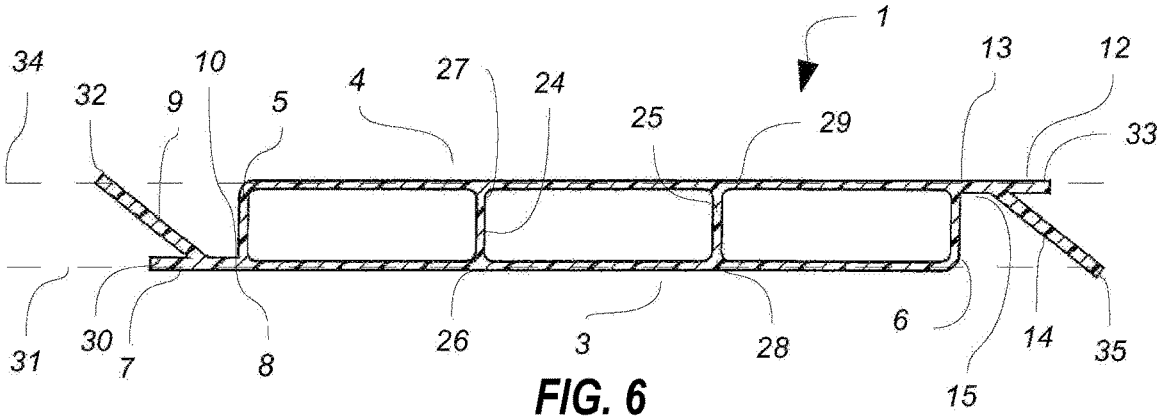
FIG. 6 is a cross-sectional transverse view of a sixth embodiment of a winged slat.
Figure 7:
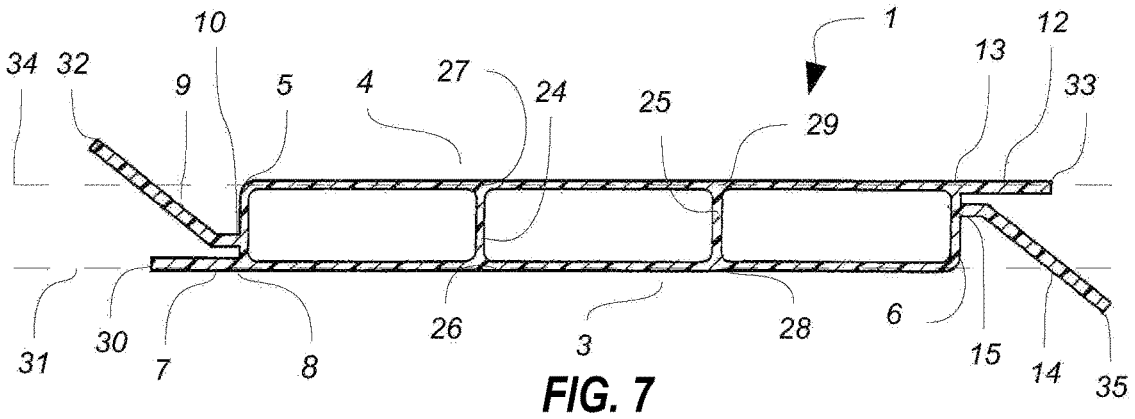
FIG. 7 is a cross-sectional transverse view of a seventh embodiment of a winged slat.
Figure 8:
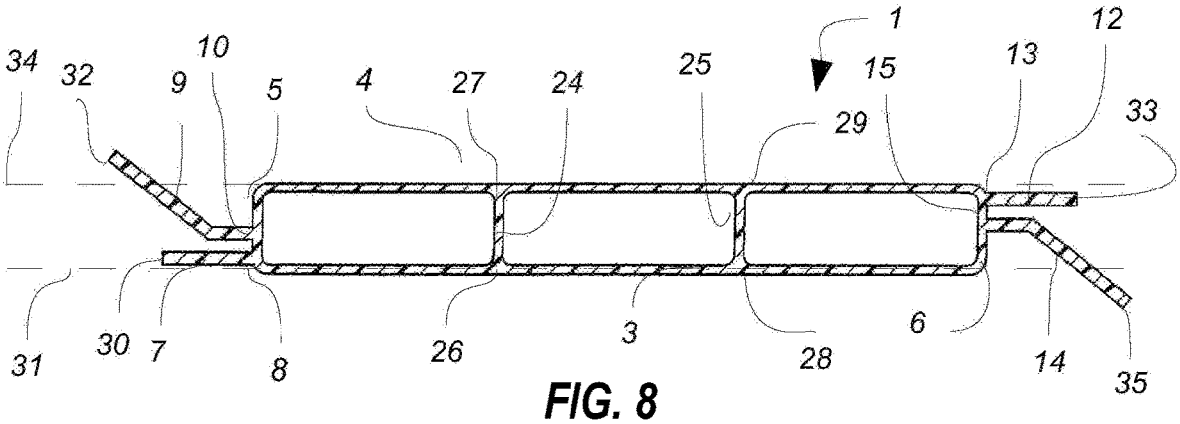
FIG. 8 is a cross-sectional transverse view of a eighth embodiment of a winged slat.
Figure 9:
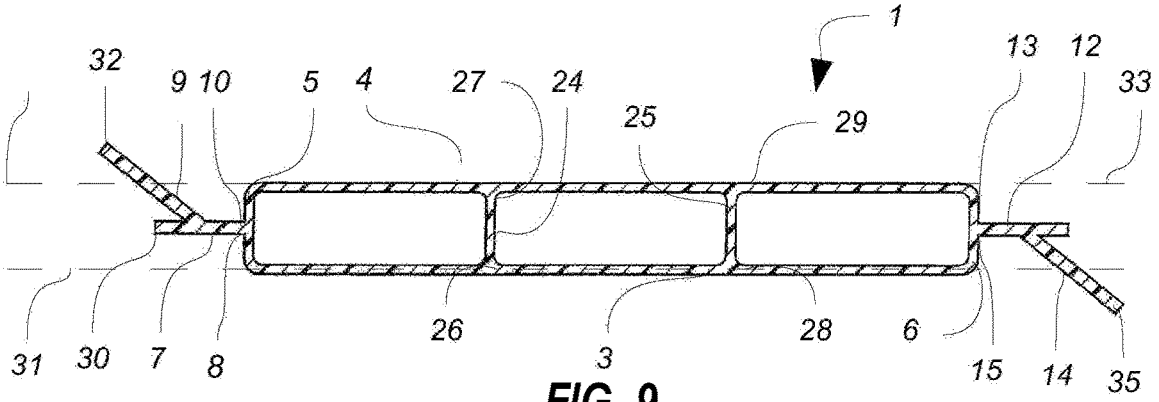
FIG. 9 is a cross-sectional transverse view of a ninth embodiment of a winged slat.

Preferably, as illustrated in FIGS. 1, 2, and 4, the first straight fin 7 and the first angled fin 9 are attached to the first edge 5 at the same place of the first edge 5; and the second straight fin 12 and the second angled fin 14 are attached to the second edge 6 at the same place of the second edge 6.

The fins 7, 9, 12, 14 are, preferably, asymmetrically arranged, i.e., as indicated above, the first straight fin 7 is diagonally opposite to the second straight fin 12, and the first angled fin 9 is diagonally opposite to the second angled fin 14. And even more preferably, the fins 7, 9, 12, 14 are precisely asymmetrically arranged, i.e., as defined herein, the fins 7, 9, 12, 14 are not only asymmetrically arranged as stated in the immediately preceding sentence, but the first straight fin 7 is the same distance from the front face 3 as the second straight fin 12 is from the rear face 4 while the first angled fin 9 is the same distance from the front face 3 as the second angled fin 14 is from the rear face 4.

Figure 11:
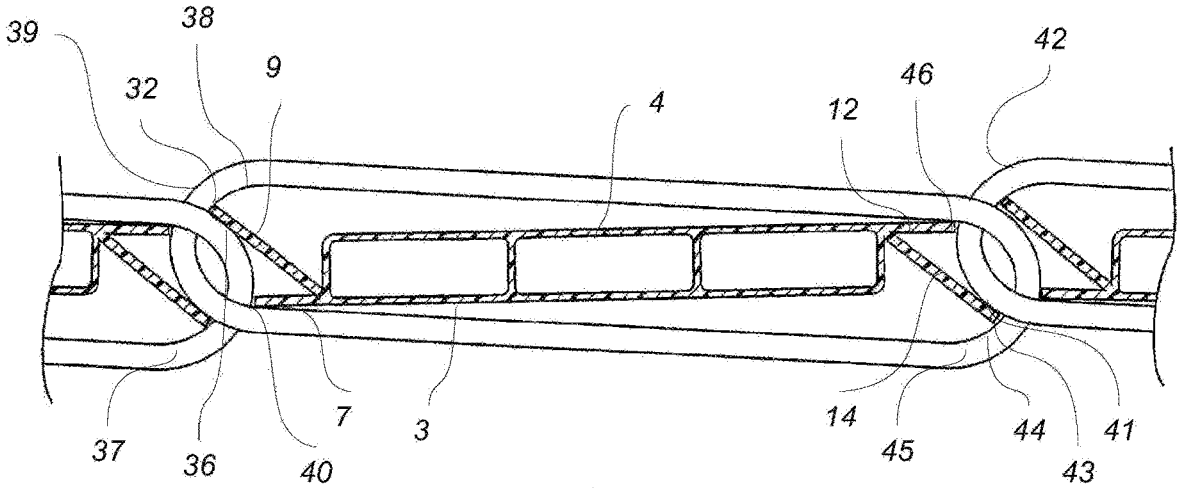
FIG. 11 is a plan view from above showing within a channel between the knuckles of the chain link fence an embodiment of a winged slat with the first angled fin riding along the outer rear portion of the first left-opening curved knuckle, the free end of the first angled fin touching the inside of the first right-opening curved knuckle, the first straight fin being outside and touching the front outer portion of the first left-opening curved knuckle, the second angled fin riding along the outer front portion of the second right-opening curved knuckle, the second angled fin touching the inside of the second left-opening curved knuckle, and the second straight fin being outside and touching the rear outer portion of the second right-opening curved knuckle.
Figure 10:
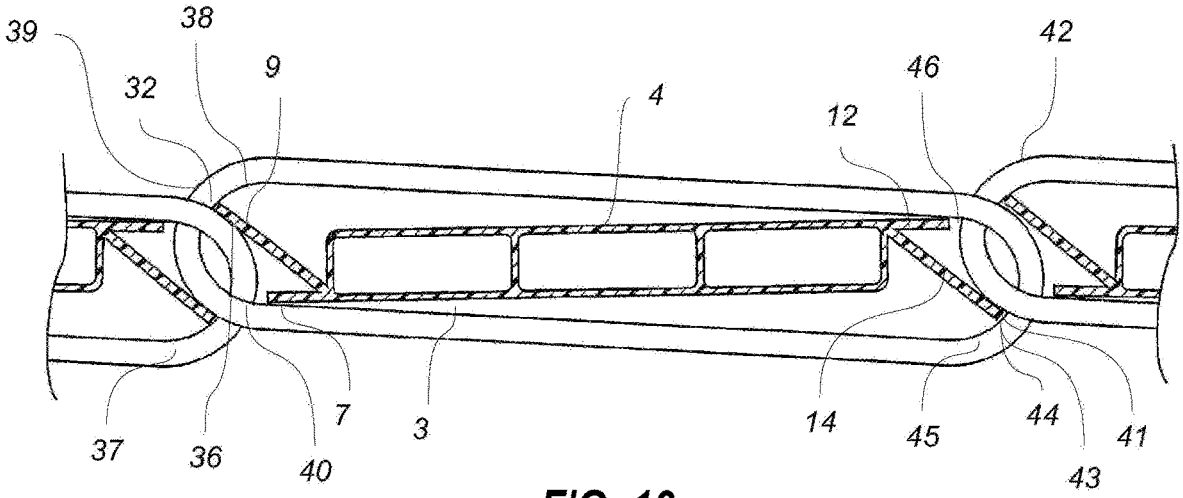
FIG. 10 is a plan view from above showing within a channel between the knuckles of the chain link fence an embodiment of a winged slat with the first angled fin riding along the outer rear portion of the first left-opening curved knuckle, the free end of the first angled fin touching the inside of the first right-opening curved knuckle, the first straight fin being outside but near the front outer portion of the first left-opening curved knuckle, the second angled fin riding along the outer front portion of the second right-opening curved knuckle, the second angled fin touching the inside of the second left-opening curved knuckle, and the second straight fin being outside but near the rear outer portion of the second right-opening curved knuckle.

In some embodiments, and as illustrated in FIG. 10, for the angled fin 9 and the straight fin 7 which are closer to the front face 3, i.e., the first straight fin 7 and the first angled fin 9, the first angled fin 9 rides along the outer rear portion 36 of the first left-opening curved knuckle 37, the free end 32 of the first angled fin 9 touches the inside 38 of the first right-opening curved knuckle 39, and the first straight fin 7 must be outside but near (and, most preferably, as shown in FIG. 11, touch) the front outer portion 40 of the first left-opening curved knuckle 37. Also preferably in some embodiments, for the angled fin 14 and the straight fin 12 which are closer to the rear face 4, i.e., the second angled fin 14 and the second straight fin 12, the second angled fin 14 rides along the outer front portion 41 of the second right-opening curved knuckle 42, the free end 43 of the second angled fin 14 touches the inside 44 of the second left-opening curved knuckle 45, and the second straight fin 12 must be outside but near (and, most preferably, as portrayed in FIG. 11, touch) the rear outer portion 46 of the second right-opening curved knuckle 42.

As portrayed in FIGS. 1, 2, 3, 10, and 14, the first straight fin 7 is preferably aligned with the front face 3 of the body 2 of the slat 1, and the second straight fin 12 is preferably aligned with the rear face 4 of the body 2 of the slat 1.

Also preferably, as depicted in FIG. 2, the angle α' between the first angled fin 9 and a plane 31 containing the front face 3 is the same as the angle α" between the second angled fin 14 and a plane 34 containing the rear face 4. And, as illustrated in FIGS. 1 through 11, preferably, the length of the first straight fin 7 is the same as the length of the second straight fin 12 (All lengths mentioned in this paragraph and the next paragraph are measured in the transverse plane 11.); and, preferably, the length of the first angled fin 9 is the same as the length of the second angled fin 14. (The largest dimension of the body 2 of the slat 1 and of the fins 7, 9, 12, 14 is the height, which is the dimension perpendicular to the transverse plane 11.)

Although the slat 1 can be constructed to fit a chain link fence of any mesh size, for a 3.5 and 5 mesh chain link fence illustrative dimensions for a slat 1 which would utilize the preferred limitations and, when most preferred limitations have been mentioned, such most preferred limitations are the following: the body 2 of the slat 1 would be 2 inches long and 0.25 inches wide, i.e., the first edge 5, the second edge 6, and the internal walls 24, 25 would be 0.25 inches long; the front face 3, the rear face 4, the first edge 5, the second edge 6, and the internal walls 24, 25 would be 0.025 inches wide; the straight fins 7, 12 would be 0.25 inches long and 0.035 inches wide; and the angled fins 9, 14 would be 0.5 inches long and 0.035 inches wide. Of these lengths and widths as well as the angles α', α" only the length of the body 2 would have to vary when the mesh of the chain link fence is different.

The angles α', α" are preferably within the range of 35° to 38°, inclusive; and, most preferably, each of these angles is 37°. Furthermore, as shown in FIGS. 6 through 9, the first angled fin 9 can initially extend perpendicularly to the first edge 5 before being bent to angle toward the rear face 4; and the second angled fin 14 can initially extend perpendicularly to the second edge 6 prior to being bent to angle toward the front face 3. In such a case, the values of the angles α', α" would differ from those stated earlier in this paragraph.

Figure 12:
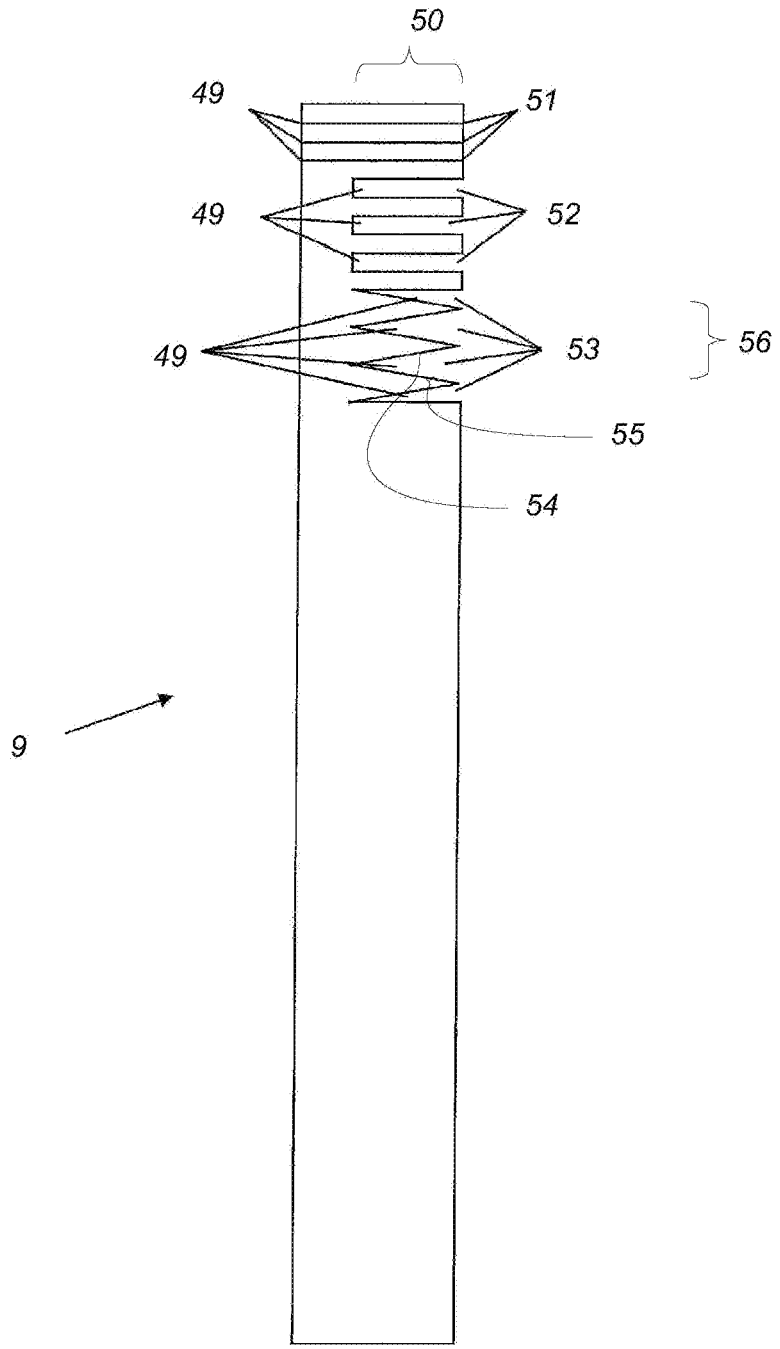
FIG. 12 shows the first angled fin containing one or more separations.

Each fin 7, 9, 12, 14, i.e., the first straight fin 7, the first angled fin 9, the second straight fin 12, and the second angled fin 14, optionally contains one or more separations 49, as illustrated in FIG. 12 for the first angled fin 9.

Such separations 49 can extend across the full length of each fin 7, 9, 12, 14 or only across part of the length of such fin 7, 9, 12, 14 and can extend the full width of each fin 7, 9, 12, 14 or only a final segment 50 of the width of such fin 7, 9, 12, 14. Furthermore, some of such separations 49 can extend the full width of such fin 7, 9, 12, 14 while other separations 49 extend across only a final segment 50 of such fin 7, 9, 12, 14.

The separation 49 can be a slit 51, a gap 52, or a notch 53 (a gap 52 with sides 54, 55 which are not parallel to one another, e.g., serrations 56). A single fin 7, 9, 12, 14 can have only one type of separation 49 or any combination of different types of separations 49.

As another way to describe the features and characteristics of various embodiments, including those set forth in FIGS. 1, 2, 5, 6, and 9, with exemplary reference to FIG. 2, each slat 1 has one or two or more pairs of fins (e.g., 7, 9), each pair of fins joined to each other at a vertex 8, 10 and longitudinally disposed on first 5 and/or second 6 sides of the generally rectangular body 2. Vertices may be located adjacent to the generally rectangular body, on the body, or between the body and distal fin ends. Alternatively, pairs of fins may omit a joining vertex, but attach to the generally rectangular body 2 at substantially the same location (see, e.g., FIGS. 3, 4, 7, and 8).

Whenever it is stated herein that a component which is indicated to be attached or connected can be, or is preferably, integrally formed, "integrally formed" is defined herein to comprise "attached" or "connected" in addition to meaning "formed as a single unit."

As used herein the term "preferable" or "preferably" means that a specified element or technique is more acceptable than another but not that such specified element or technique is a necessity.

As used herein, the terms "straight" (as in "straight fin"), "rectangular", "angled", "perpendicular", "perpendicularly", "bent", "aligned" and the like are to be construed as being preceded in all cases by the adjective "generally". More specifically, in various embodiments herein and other embodiments not expressly described or illustrated, elements of the present invention are constructed of materials, which by their nature, may flex, bend, distort, and/or depart from their original fixed and/or molded shapes. This bending or departure from original shape does not represent a departure from the purposes or scope of the invention or the claims set forth below, but rather, are still expressly claimed herein. The term "generally" is defined herein as +/−49% of the stated value or characteristic.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A winged slat for a chain link fence, which comprises:

a longitudinally-extending hollow body comprising a front face, a back face, a first sidewall and a second sidewall; and a pair of generally non-coplanar, bifurcate fins joined to each other at a vertex and longitudinally disposed adjacent one of the first and second sidewalls of the body, the pair of fins comprising:

a first fin generally parallel to a plane generally containing one of the front and back faces of the body; and a second fin generally angled in a traverse plane of the body toward the other of the front and back faces of the body, wherein each fin has a distal fin end opposite the vertex that extends away from the body, wherein the vertex is located adjacent to the body and between the body and the distal fin ends, and wherein the vertex and each of the fins longitudinally-extend along the body parallel to a longitudinal axis of the body.

2. The winged slat for a chain link fence of claim 1, the vertex located on the body.

3. The winged slat for a chain link fence of claim 1, wherein the body is generally rectangular.

4. A winged slat for a chain link fence, which comprises:

a longitudinally-extending generally rectangular hollow body comprising a front face, a back face, a first sidewall, and a second sidewall; and a pair of generally non-coplanar, bifurcate fins joined to each other at a vertex and longitudinally disposed adjacent one of the first and second sidewalls of the body, the pair of fins comprising:

a first fin generally parallel to a plane generally containing one of the front and back faces of the body; and a second fin generally angled in a traverse plane of the body toward the other of the front and back faces of the body, wherein each fin has a distal fin end opposite the vertex that extends away from the body, wherein the vertex is located adjacent to the body and between the body and the distal fin ends, and wherein the vertex and each of the fins longitudinally-extend along the body parallel to a longitudinal axis of the body.

5. The winged slat for a chain link fence of claim 4, the vertex located on the generally rectangular body.

6. A dual-winged slat for a chain link fence, which comprises:

a longitudinally-extending generally rectangular hollow body comprising, a front face, a back face, a first sidewall, and a second sidewall;

a first pair of generally non coplanar, bifurcate fins joined to each other at a first vertex and longitudinally disposed adjacent the first sidewall of the generally rectangular body, the first pair of fins comprising:

a first fin generally parallel to a plane generally containing one of the front and back faces of the body; and a second fin generally angled in a traverse plane of the body toward the other of the front and back faces of the body;

wherein each fin of the first air of fins has a distal fin end opposite the first vertex that extends away from the body, wherein the first vertex is located adjacent to the body and between the body and the distal fin ends of the first pair of fins, and wherein the first vertex and each of the first pair of fins longitudinally-extend along the body parallel to a longitudinal axis of the body; and a second pair of generally non-coplanar, bifurcate fins joined to each other at a second vertex and longitudinally disposed adjacent the second sidewall of the generally rectangular body, the second pair of fins comprising:

a third fin generally parallel to a plane generally containing one of the front and back faces of the body; and a fourth fin generally angled in a traverse plane of the body toward the other of the front and back faces of the body;

wherein each fin of the second pair of fins has a distal fin end opposite the second vertex that extends away from the body, wherein the second vertex is located adjacent to the body and between the body and the distal fin ends of the second pair of fins, and wherein the second vertex and each of the second pair of fins longitudinally-extend along the body parallel to the longitudinal axis of the body.

7. The dual-winged slat for a chain link fence of claim 6, the first and second vertices located on the generally rectangular body.

8. The dual-winged slat for a chain link fence of claim 6, the first pair of fins attached to the generally rectangular body at substantially the same location.

9. The dual-winged slat for a chain link fence of claim 6, the second pair of fins attached to the generally rectangular body at substantially the same location.

* * * * *